US007019613B2

(12) United States Patent
Nihira et al.

(10) Patent No.: US 7,019,613 B2
(45) Date of Patent: Mar. 28, 2006

(54) PTC THERMISTOR BODY, PTC THERMISTOR, METHOD OF MAKING PTC THERMISTOR BODY, AND METHOD OF MAKING PTC THERMISTOR

(75) Inventors: Yoshito Nihira, Akita (JP); Noriaki Hirano, Akita (JP); Hisanao Tosaka, Akita (JP)

(73) Assignee: TDK Corporation, Tokyo (JP)

( * ) Notice: Subject to any disclaimer, the term of this patent is extended or adjusted under 35 U.S.C. 154(b) by 50 days.

(21) Appl. No.: 10/463,592

(22) Filed: Jun. 18, 2003

(65) Prior Publication Data

US 2003/0234717 A1 Dec. 25, 2003

(30) Foreign Application Priority Data

Jun. 24, 2002 (JP) ..... P2002-182695
Jun. 6, 2003 (JP) ..... P2003-162544

(51) Int. Cl.
*H01C 7/10* (2006.01)

(52) U.S. Cl. ..... 338/22 R; 29/610.1; 29/612; 252/513

(58) Field of Classification Search ..... 338/22 R; 252/513; 29/610.1, 612
See application file for complete search history.

(56) References Cited

U.S. PATENT DOCUMENTS

| | | | | |
|---|---|---|---|---|
| 3,243,753 | A | 3/1966 | Kohler | |
| 3,269,862 | A | 8/1966 | Lanza et al. | |
| 3,351,882 | A | 11/1967 | Kohler et al. | |
| 5,378,407 | A | 1/1995 | Chandler et al. | |
| 5,982,271 | A | 11/1999 | Handa | |
| 6,558,579 | B1 * | 5/2003 | Handa et al. | 252/511 |
| 2002/0093007 | A1 * | 7/2002 | Handa et al. | 252/500 |
| 2002/0145130 | A1 * | 10/2002 | Handa et al. | 252/500 |

FOREIGN PATENT DOCUMENTS

| | | |
|---|---|---|
| EP | 1 058 277 A1 | 12/2000 |
| JP | A 62-51184 | 3/1987 |
| JP | A 62-51185 | 3/1987 |
| JP | A 62-51186 | 3/1987 |
| JP | A 62-51187 | 3/1987 |
| JP | B2 62-16523 | 4/1987 |
| JP | A 1-231284 | 9/1989 |
| JP | A 3-132001 | 6/1991 |
| JP | A 5-47503 | 2/1993 |
| JP | B2 7-48396 | 5/1995 |
| JP | B2 7-109786 | 11/1995 |
| JP | A 9-27383 | 1/1997 |
| JP | A 9-69410 | 3/1997 |
| JP | A 11-168005 | 6/1999 |
| JP | A 2000-82602 | 3/2000 |
| JP | A 2000-133502 | 5/2000 |
| JP | 2000-133503 | 5/2000 |
| JP | A 2000-133503 | 5/2000 |
| JP | A 2001-52901 | 2/2001 |
| JP | A 2001-102203 | 4/2001 |
| WO | WO 96/41354 | 6/1996 |

* cited by examiner

*Primary Examiner*—Karl D. Easthom
(74) *Attorney, Agent, or Firm*—Oliff & Berridge, PLC

(57) ABSTRACT

A PTC thermistor 10 comprises, at least, a pair of electrodes 2, 3 and a thermistor body 1, disposed between the electrodes 2, 3, having a positive resistance vs. temperature characteristic. The thermistor body includes, at least, a thermoplastic resin and an electrically conductive particle made of a metal powder. The thermoplastic resin and electrically conductive particle have respective contents and a state of dispersion adjusted so as to yield a magnetization of $4.0\times10^{-5}$ to $6.0\times10^{-5}$ $Wb\cdot m\cdot kg^{-1}$ when a magnetic field of $3.98\times10^{5}$ $A\cdot m^{-1}$ is applied to the thermistor body.

24 Claims, 5 Drawing Sheets

PTC THERMISTOR BODY, PTC THERMISTOR, METHOD OF MAKING PTC THERMISTOR BODY, AND METHOD OF MAKING PTC THERMISTOR

BACKGROUND OF THE INVENTION

1. Field of the Invention

The present invention relates to a PTC (Positive Temperature Coefficient) thermistor. More specifically, the present invention relates to a PTC thermistor having a thermistor body disposed between a pair of electrodes, whereas the thermistor body is constituted by a shaped article made of a thermoplastic resin, a low molecular weight organic compound, and an electrically conductive particle. The PTC thermistor of the present invention is favorably usable as a temperature sensor and an overcurrent protection device (e.g., an overcurrent protection device for a lithium ion battery).

2. Related Background Art

The PTC (Positive Temperature Coefficient) thermistor has a configuration comprising, at least, a pair of electrodes opposing each other, and a thermistor body disposed between the pair of electrodes. The thermistor body has a "positive resistance vs. temperature characteristic" in which its resistance value drastically increases as temperature rises.

By utilizing the above-mentioned characteristic, the PTC thermistor is used, for example, as a self-control type heat generator, a temperature sensor, a current limiting device, an overcurrent protection device, and the like for protecting circuits of electronic devices. From the viewpoint of the usage mentioned above and the like, the PTC thermistor is required to have a low resistance value at room temperature when not operating, a large change ratio between the resistance value at room temperature when not operating and that during operation, a small amount of change in resistance value when operated repeatedly (the difference between the resistance value at an initial stage of use and that after repeated operations), an excellent breaking characteristic, a low temperature generated by the device, and an ability to reduce its size, weight, and cost.

A common type of the PTC thermistor is equipped with a thermistor body made of a ceramics material. However, this type of PTC thermistor has been poor in the breaking characteristic, high in the temperature generated by the thermistor body, and hard to reduce its size, weight, and cost.

Therefore, in order to respond to the above-mentioned requirement for lowering the operation temperature and the like, a PTC thermistor of a type comprising a shaped article made of a thermoplastic region (polymer matrix) and an electrically conductive fine particle as a thermistor body (hereinafter referred to as "P-PTC thermistor" when necessary) has been under consideration.

Proposed as such a P-PTC thermistor is of a type in which a shaped article comprising electrically conductive fine particles dispersed into a crystalline polymer, which is a thermoplastic resin, is provided as a thermistor body (see, for example, the following patent literatures 1 and 2). The reason why the resistance value in such a P-PTC thermistor drastically increases at a predetermined temperature is presumed to be because the crystalline polymer constituting the thermistor body inflates as it melts, thereby cutting an electric conduction path constructed by the electrically conductive fine particles in the thermistor body.

Proposed as another example of P-PTC thermistor is of a type in which, for example, a shaped article obtained by mixing a crystalline polymer as a thermoplastic resin, a low molecular weight organic compound (having an average molecular weight of less than 2,000, for example), and electrically conductive fine particles (including carbon black as a main ingredient) is provided as a thermistor body (see, for example, patent literatures 3 to 13). This P-PTC thermistor seems to increase its resistance value when the low molecular weight organic compound melts.

Proposed as still another example of P-PTC thermistor is of a type in which a shaped article including an Ni metal powder having spiky protrusions as electrically conductive fine particles is provided as a thermistor body (see, for example, patent documents 14 and 15).

Patent Literature 1
U.S. Pat. No. 3,243,753
Patent Literature 2
U.S. Pat. No. 3,351,882
Patent Literature 3
Japanese Patent Publication No. SHO 62-16523
Patent Literature 4
Japanese Patent Publication No. HEI 7-109786
Patent Literature 5
Japanese Patent Publication No. HEI 7-48396
Patent Literature 6
Japanese Patent Application Laid-Open No. SHO 62-51184
Patent Literature 7
Japanese Patent Application Laid-Open No. SHO 62-51185
Patent Literature 8
Japanese Patent Application Laid-Open No. SHO 62-51186
Patent Literature 9
Japanese Patent Application Laid-Open No. SHO 62-51187
Patent Literature 10
Japanese Patent Application Laid-Open No. HEI 1-231284
Patent Literature 11
Japanese Patent Application Laid-Open No. HEI 3-132001
Patent Literature 12
Japanese Patent Application Laid-Open No. HEI 9-27383
Patent Literature 13
Japanese Patent Application Laid-Open No. HEI 9-69410
Patent Literature 14
U.S. Pat. No. 5,378,407
Patent Literature 15
Japanese Patent Application Laid-Open No. HEI 5-47503

SUMMARY OF THE INVENTION

However, conventional P-PTC thermistors such as those disclosed in the above-mentioned patent literatures 1 and 2 may have been problematic in that the degree of crystallinity of the thermoplastic resin contained in the thermistor body is so low that the rising edge of a resistance vs. temperature characteristic curve observed when the resistance increases as temperature rises fails to become steep. Also, the thermoplastic resin (polymer) is likely to attain an overcooled state, thereby usually exhibiting a hysteresis characteristic in which the same resistance value is obtained at a lower temperature at the time of lowering temperature in which the resistance decreases along the resistance vs. temperature characteristic curve than at the time of raising temperature in which the resistance increases along the resistance vs. temperature characteristic curve.

Conventional P-PTC thermistors containing a low molecular weight organic compound such as those disclosed in the above-mentioned patent literatures 3 to 13 use a low molecular weight organic compound having a higher degree of crystallinity than that of thermoplastic resins (e.g., crystalline polymer), thereby being advantageous in that their degree of freedom in characteristic control is high, so that they can attain a steep rising edge at the time when the resistance increases as temperature rises, reduce the occurrence of the above-mentioned hysteresis, easily control the temperature at which the resistance value of the resistance vs. temperature characteristic curve increases (hereinafter referred to as operation temperature), and so forth.

However, conventional P-PTC thermistors containing a low molecular weight organic compound such as those disclosed in the above-mentioned patent literatures 3 to 13 use carbon black as their main electrically conductive fine particles, and thus may lower the resistance change ratio during operation when their initial resistance value is lowered by enhancing the amount of carbon black.

Conventional P-PTC thermistors such as those disclosed in patent literatures 14 and 15 are aimed at solving the above-mentioned problem of decrease in resistance change ratio during operation, and thus are expected to attain a low initial resistance value and a large resistance change ratio if electrically conductive fine particles can be dispersed uniformly into a crystalline polymer which is a thermoplastic resin.

However, conventional P-PTC thermistors such as those disclosed in patent literatures 14 and 15 are very hard to control the state of dispersion of electrically conductive fine particles within the crystalline polymer, so that the state of dispersion of electrically conductive fine particles within the crystalline polymer is likely to become uneven, thereby generating the following problems. Namely, conventional P-PTC thermistors such as those disclosed in patent literatures 14 and 15 may have been problematic in that their resistance value at room temperature when not operating becomes high and that the change ratio between the resistance value at room temperature when not operating and that during operation becomes small.

Also, PTC thermistors are required to have an electric characteristic (reliability for repeated operations) in which the resistance value (measured at room temperature, i.e., 25° C.) after a predetermined number of repeated heating and cooling operations can continuously reproduce a low value substantially on a par with the resistance value (measured at room temperature, i.e., 25° C.) at an initial stage of use. As this resistance value is higher, the power consumption of PTC thermistors increases, which may be problematic in particular when electronic devices mounted with the PTC thermistors are small-size devices such as cellular phones. The inventors have found that conventional P-PTC thermistors such as those disclosed in patent literatures 14 and 15 may be problematic in that they increase their resistance value after repeated operations or short-circuit during operation, thus failing to reach a practical level yet.

In view of such problems of prior art, it is an object of the present invention to provide a PTC thermistor body capable of constructing a highly reliable PTC thermistor which can yield a sufficiently large change ratio between the resistance value at room temperature when not operating and that during operation, and sufficiently keep the resistance value obtained at an initial stage of use even after being operated repeatedly; and a PTC thermistor comprising the same. It is another object of the present invention to provide a method of making a PTC thermistor body which can construct the above-mentioned PTC thermistor body of the present invention easily and securely, and a method of making a PTC thermistor with a high product yield, which can construct the above-mentioned PTC thermistor of the present invention easily and securely.

The inventors conducted diligent studies in order to achieve the above-mentioned objects and, as a result, have found that there is a correlation between a magnetic characteristic of a thermistor body and an electric characteristic of a finally obtained PTC thermistor when the thermistor body is constructed by a shaped article including, at least, a thermoplastic resin and an electrically conductive particle having an electronic conductivity (preferably a shaped article including, at least, a thermoplastic resin, a low molecular weight organic compound, and an electrically conductive particle having an electronic conductivity).

Further, for achieving the above-mentioned objects, the inventors have found it very effective to adjust the contents of the thermoplastic resin and electrically conductive particle in the thermistor body and the state of dispersion of the thermoplastic resin and electrically conductive particle (preferably the contents of the thermoplastic resin, low molecular weight organic compound, and electrically conductive particle, and the state of dispersion of the thermoplastic resin, low molecular weight organic compound, and electrically conductive particle) such that a specific range of magnetization is attained when a specific magnetic field is applied to the thermistor body, thereby accomplishing the present invention.

Namely, the present invention provides a PTC thermistor body disposed between a pair of electrodes opposing each other in a PTC thermistor having a positive resistance vs. temperature characteristic; the PTC thermistor body including, at least, a thermoplastic resin and an electrically conductive particle made of a metal powder, the thermoplastic resin and electrically conductive particle having respective contents and a state of dispersion adjusted so as to yield a magnetization of $4.0\times10^{-5}$ to $6.0\times10^{-5}$ $Wb\cdot m\cdot kg^{-1}$ when a magnetic field of $3.98\times10^{5}$ $A\cdot m^{-1}$ is applied to the PTC thermistor body.

Using the PTC thermistor body satisfying the condition to yield a magnetization of $4.0\times10^{-5}$ to $6.0\times10^{-5}$ $Wb\cdot m\cdot kg^{-1}$ when a magnetic field of $3.98\times10^{5}$ $A\cdot m^{-1}$ is applied thereto can easily and securely construct a highly reliable PTC thermistor which can yield a sufficiently large change ratio between the resistance value at room temperature when not operating and that during operation, and sufficiently keep the resistance value obtained at an initial stage of use even after being operated repeatedly.

Also, using the PTC thermistor body of the present invention can easily and securely construct a PTC thermistor yielding a sufficiently low resistance value at room temperature when not operating and sufficiently reduced fluctuations in resistance of the thermistor device. Further, using the PTC thermistor body of the present invention can sufficiently prevent the part of PTC thermistor body from short-circuiting, thereby improving the product yield when making the PTC thermistor.

Since the PTC thermistor body of the present invention contains a metal powder, the latter is magnetized when a magnetic field is applied thereto, whereby the magnetization of the PTC thermistor body can be measured. Though details of the effects of the present invention have not clearly been elucidated, the inventors presume that the PTC thermistor body satisfying the above-mentioned condition between the applied magnetic field and magnetization realizes a state in which the thermoplastic resin and metal powder are dispersed in a sufficiently uniform fashion.

If the magnetization is less than $4.0\times10^{-5}$ Wb·m·kg$^{-1}$ when a magnetic field of $3.98\times10^{5}$ A·m$^{-1}$ is applied, the thermistor body will increase its resistance at room temperature (25° C.), thereby failing to sufficiently keep the resistance value obtained at an initial stage of use after repeated operations. If the magnetization exceeds $6.0\times10^{-5}$ Wb·m·kg$^{-1}$ when a magnetic field of $3.98\times10^{5}$ A·m$^{-1}$ is applied, the thermistor body will lower its resistance at room temperature (25° C.), thereby failing to attain the change ratio between the resistance value at room temperature when not operating and the resistance value during operation as a sufficiently large value.

The value of magnetization at the time when a magnetic field of $3.98\times10^{5}$ A·m$^{-1}$ is applied to the thermistor body in the present invention is the arithmetic mean value of data (magnetization values) obtained by at least five different measurement samples prepared under the same manufacturing condition.

Also, the present invention provides a PTC thermistor body disposed between a pair of electrodes opposing each other in a PTC thermistor having a positive resistance vs. temperature characteristic; the PTC thermistor body including, at least, a thermoplastic resin and an electrically conductive particle made of a metal powder, the thermoplastic resin and electrically conductive particle having respective contents and a state of dispersion adjusted so as to yield a magnetization of $4.0\times10^{-5}$ to $6.0\times10^{-5}$ Wb·m·kg$^{-1}$ when a magnetic field of $3.98\times10^{5}$ A·m$^{-1}$ is applied to a pulverized product of the PTC thermistor body.

Thus, the magnetization at the time when a magnetic field of $3.98\times10^{5}$ A·m$^{-1}$ is applied to a pulverized product (particle) obtained by pulverizing the PTC thermistor body may be measured as well. The above-mentioned effects of the present invention can be obtained by adjusting the contents of the thermoplastic resin and electrically conductive particle so as to attain a magnetization of $4.0\times10^{-5}$ to $6.0\times10^{-5}$ Wb·m·kg$^{-1}$ in this case as well. Applying a magnetic field to a pulverized product obtained by pulverizing the PTC thermistor body and then measuring the magnetization of the pulverized product can measure the magnetization of the PTC thermistor body more accurately. Preferably, the pulverized product (particle) has an average particle size of about 1 mm, for example.

The present invention provides a PTC thermistor comprising, at least, a pair of electrodes opposing each other and a thermistor body, disposed between the pair of electrodes, having a positive resistance vs. temperature characteristic; wherein the PTC thermistor body is one of the above-mentioned PTC thermistor bodies of the present invention.

Since the PTC thermistor of the present invention comprises one of the above-mentioned PTC thermistor bodies of the present invention, it yields a sufficiently large change ratio between the resistance value at room temperature when not operating and that during operation, and has such an excellent reliability as to sufficiently keep the resistance value obtained at an initial stage of use even after being operated repeatedly.

Further, the present invention provides a method of making a PTC thermistor body disposed between a pair of electrodes opposing each other in a PTC thermistor having a positive resistance vs. temperature characteristic, the method comprising a kneaded product preparing step of preparing a kneaded product including, at least, a thermoplastic resin and an electrically conductive particle made of a metal powder; a shaping step of shaping the kneaded product into a plurality of sheet-like shaped articles; a magnetization measuring step of measuring respective magnetization values of the plurality of shaped articles when a magnetic field of $3.98\times10^{5}$ A·m$^{-1}$ is applied thereto; and a selecting step of choosing from the plurality of shaped articles a shaped article satisfying a condition to yield a magnetization of $4.0\times10^{-5}$ to $6.0\times10^{-5}$ Wb·m·kg$^{-1}$ and excluding a shaped article failing to satisfy the condition.

Measuring magnetization values of PTC thermistor bodies obtained while applying a magnetic field of $3.98\times10^{5}$ A·m$^{-1}$ thereto in the magnetization measuring step and using only those satisfying a condition to yield a magnetization falling within the range of $4.0\times10^{-5}$ to $6.0\times10^{-5}$ Wb·m·kg$^{-1}$ when a magnetic field of $3.98\times10^{5}$ A·m$^{-1}$ is applied thereto in the selecting step (as the PTC thermistor body of the present invention) can easily and securely construct a highly reliable PTC thermistor which can yield a sufficiently large change ratio between the resistance value at room temperature when not operating and that during operation, and sufficiently keep the resistance value obtained at an initial stage of use even after being operated repeatedly.

Namely, the method of making a PTC thermistor body in accordance with the present invention can construct the above-mentioned PTC thermistor body of the present invention easily and securely. In the magnetization measuring step, when shaped articles formed under the same shaping condition from the same kneaded product can be considered to belong to a single group having the same magnetization characteristic, they may be grouped, at least one shaped article may be chosen from the shaped articles of the kneaded products belonging to this single group as a magnetization characteristic evaluation sample representing the group, and the magnetization of the shaped article as the magnetization characteristic evaluation sample may be measured alone, so as to evaluate a magnetization characteristic of the whole group, as in the grouping step in the making method in accordance with another aspect of the present invention which will be explained later.

The present invention provides a method of making a PTC thermistor body disposed between a pair of electrodes opposing each other in a PTC thermistor having a positive resistance vs. temperature characteristic, the method comprising a kneaded product preparing step of preparing a kneaded product including, at least, a thermoplastic resin and an electrically conductive particle made of a metal powder; a shaping step of shaping the kneaded product into a plurality of sheet-like shaped articles; a grouping step of grouping the plurality of shaped articles into at least one group by grouping shaped articles formed under the same shaping condition from the same kneaded product as shaped articles belonging to the same group; a pulverizing step of arbitrarily choosing at least one of the shaped products belonging to the same group in at least one group and then pulverizing thus chosen at least one shaped product so as to yield a pulverized product of the shaped article for each group; a magnetization measuring step of measuring magnetization values of pulverized products obtained for respective groups when a magnetic field of $3.98\times10^{5}$ A·m$^{-1}$ is applied thereto; and a selecting step of choosing a shaped product of a group including a pulverized product satisfying a condition to yield a magnetization of $4.0\times10^{-5}$ to $6.0\times10^{-5}$ Wb·m·kg$^{-1}$ among the pulverized products and excluding a shaped article of a group including a pulverized product failing to satisfy the condition.

In the grouping step, shaped articles of kneaded products belonging to a single group formed under the same forming condition from the same kneaded product are considered to have the same magnetization characteristic, and at least one of the shaped articles belonging to this group is chosen as a magnetization characteristic evaluation sample representing this group. Then, only the shaped article as the magnetization characteristic evaluation sample is pulverized, and the magnetization of thus pulverized product is measured, so as to evaluate the magnetization characteristic of the whole group. Thus, the magnetization of the pulverized product (particle) obtained by pulverizing the PTC thermistor body may be measured while applying a magnetic field of $3.98\times10^5$ $A\cdot m^{-1}$ thereto. The above-mentioned effects of the present invention can be obtained by adjusting the contents of the thermoplastic resin and electrically conductive particle so as to attain a magnetization of $4.0\times10^{-5}$ to $6.0\times10^{-5}$ $Wb\cdot m\cdot kg^{-1}$ in this case as well. Applying a magnetic field to a pulverized product obtained by pulverizing the PTC thermistor body and then measuring the magnetization of the pulverized product can measure the magnetization of the PTC thermistor body more accurately. Preferably, the pulverized product (particle) has an average particle size of about 1 mm, for example.

Also, the present invention provides a method of making a PTC thermistor body disposed between a pair of electrodes opposing each other in a PTC thermistor having a positive resistance vs. temperature characteristic, the method comprising a kneaded product preparing step of preparing a kneaded product including, at least, a thermoplastic resin and an electrically conductive particle made of a metal powder; and a shaping step of shaping the kneaded product into a plurality of sheet-like shaped articles; wherein a kneading condition in the kneaded product preparing step and a shaping condition in the shaping step are adjusted such that the plurality of shaped products satisfy a condition to yield a magnetization of $4.0\times10^{-5}$ to $6.0\times10^{-5}$ $Wb\cdot m\cdot kg^{-1}$ when a magnetic field of $3.98\times10^5$ $A\cdot m^{-1}$ is applied thereto.

When a kneading condition in the kneaded product preparing step and a shaping condition in the shaping step are thus adjusted such that the shaped products satisfy the above-mentioned condition at the time when the magnetic field is applied thereto, the state of dispersion of the thermoplastic resin and electrically conductive particle in the PTC thermistor body can also be adjusted to a favorable state, whereby the above-mentioned effects of the present invention can be attained.

Further, the present invention provides a method of making a PTC thermistor comprising, at least, a pair of electrodes opposing each other and a thermistor body, disposed between the pair of electrodes, having a positive resistance vs. temperature characteristic; the method comprising a body forming step of forming a PTC thermistor body by one of the above-mentioned methods of making a PTC thermistor body in accordance with the present invention; and a step of disposing the PTC thermistor body between the pair of electrodes and electrically connecting the pair of electrodes and the PTC thermistor body to each other.

The method of making a PTC thermistor in accordance with the present invention can easily and securely construct the above-mentioned PTC thermistor of the present invention with a high product yield.

DESCRIPTION OF THE PREFERRED EMBODIMENTS

In the following, preferred embodiments of the present invention will be explained in detail with reference to the drawings. In the following explanations, parts identical or equivalent to each other will be referred to with numerals identical to each other, without repeating their overlapping descriptions.

Figure 1:
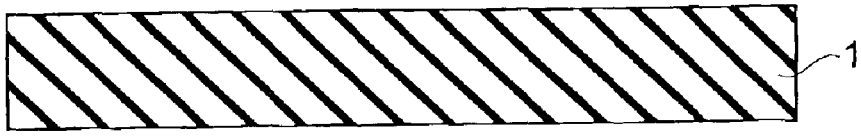
FIG. 1 is a schematic sectional view showing the basic configuration of a preferred embodiment of the PTC thermistor body in accordance with the present invention.
Figure 2:
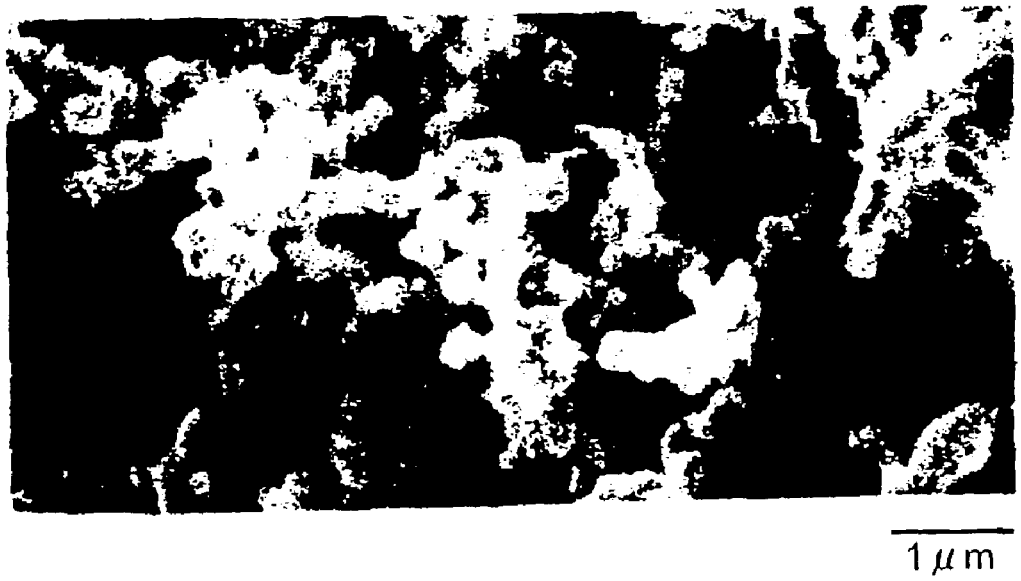
FIG. 2 is a view showing an SEM photograph of a filamentary metal powder included in the PTC thermistor body shown in FIG. 1.
Figure 3:
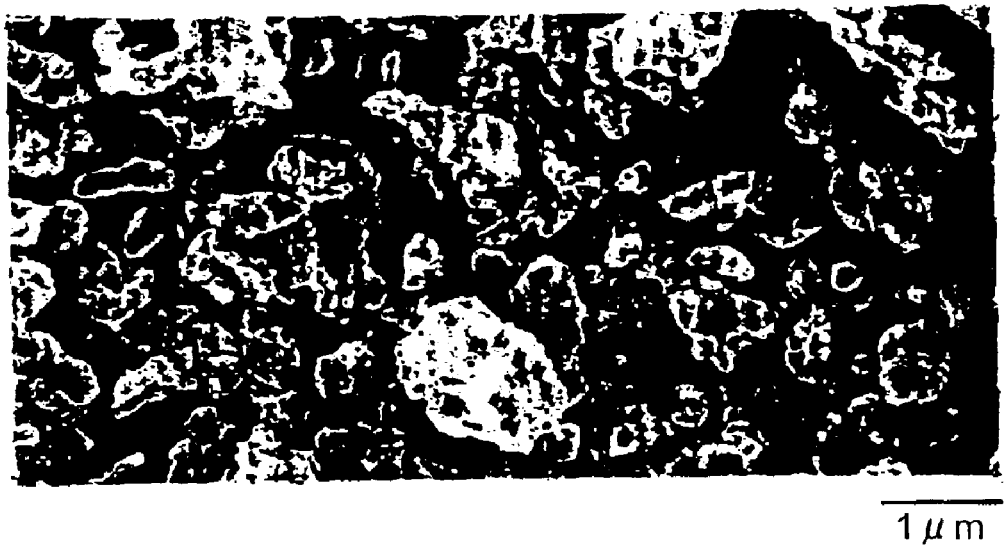
FIG. 3 is a view showing an SEM photograph of a nonfilamentary metal powder for comparison with the metal powder shown in FIG. 2.
Figure 4:
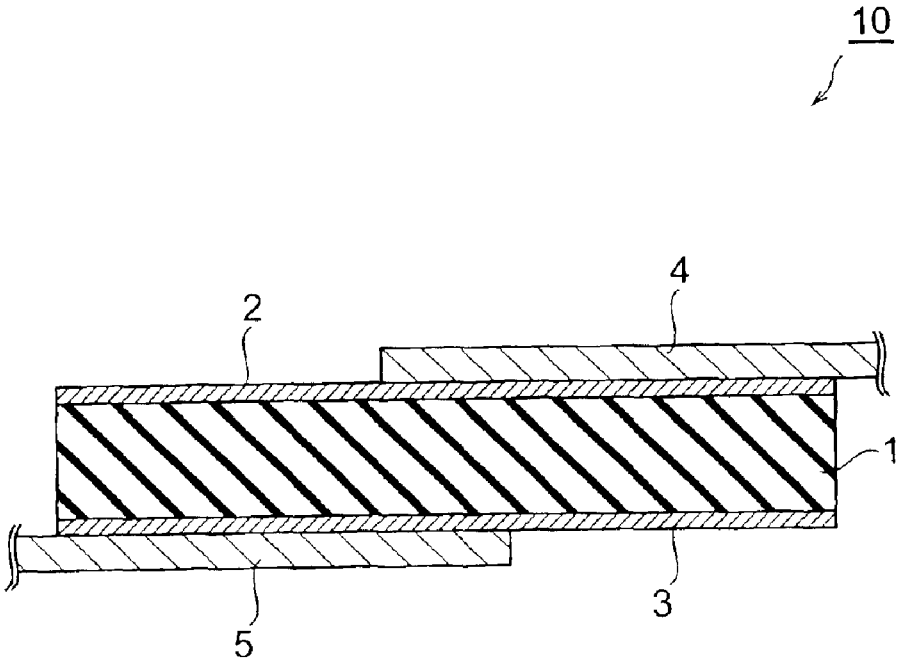
FIG. 4 is a schematic sectional view showing the basic configuration of a preferred embodiment of the PTC thermistor in accordance with the present invention.

FIG. 1 is a schematic sectional view showing the basic configuration of a preferred embodiment of the PTC thermistor body in accordance with the present invention. FIG. 2 is a view showing an SEM photograph of a filamentary metal powder included in the PTC thermistor body shown in FIG. 1. FIG. 3 is a view showing an SEM photograph of a nonfilamentary metal powder for comparison with the metal powder shown in FIG. 2. FIG. 4 is a schematic sectional view showing the basic configuration of a preferred embodiment of the PTC thermistor in accordance with the present invention.

The PTC thermistor 10 shown in FIG. 4 is mainly constituted by a pair of electrodes 2, 3 opposing each other; a thermistor body 1, disposed between the electrodes 2, 3, having a positive resistance vs. temperature characteristic; a lead 4 electrically connected to the electrode 2; and a lead 5 electrically connected to the electrode 3.

The electrodes 2, 3 have a flat form, for example, and are not restricted in particular as long as they have an electronic conductivity to function as an electrode for a PTC thermistor. The leads 4, 5 are not restricted in particular as long as they have such an electronic conductivity as to be able to release or inject electrons from their corresponding electrodes 2, 3 to the outside.

The PTC thermistor body 1 of the PTC thermistor 10 shown in FIG. 1 is a shaped article comprising a thermoplastic resin, a low molecular weight organic compound, and an electrically conductive particle having an electronic conductivity. The PTC thermistor body 1 is one which yields a magnetization of $4.0\times10^{-5}$ to $6.0\times10^{-5}$ $Wb\cdot m\cdot kg^{-1}$ when a magnetic field of $3.98\times10^5$ $A\cdot m^{-1}$ is applied thereto. Since the PTC thermistor body 1 contains a metal powder, the latter is magnetized when a magnetic field is applied thereto, whereby the magnetization of the PTC thermistor body 1 can be measured.

Satisfying this condition between the applied magnetic field and magnetization can yield a sufficiently low resistance value at room temperature in the unoperated state. Also, this can secure a sufficiently large change ratio between the resistance value at room temperature in the unoperated state and that during operation. Further, this can sufficiently reduce the change in electric characteristics of the thermistor even after repeating temperature changes (cycles of heating and cooling). Also, this can sufficiently lower fluctuations in device resistance of the PTC thermistor 10. Further, this can sufficiently prevent the PTC thermistor body 1 in operation from short-circuiting. Also, this can stabilize quality characteristics of the PTC thermistor 10 and improve the product yield. The inventors presume that the reason why the foregoing effects can be obtained is because satisfying the above-mentioned condition between the applied magnetic field and magnetization disperses the magnetic powder in the thermoplastic resin in a sufficiently uniform fashion. This point will be explained more specifically with reference to experimental data in Examples which will be mentioned later.

From the viewpoint of yielding the effects of the present invention more securely, the thermoplastic resin included in the PTC thermistor body 1 is preferably a crystalline polymer. In order to prevent the thermoplastic resin from flowing and the body from deforming as the low molecular weight organic compound melts during operation, the melting point of the thermoplastic resin is desirably higher than that of the low molecular weight organic compound, preferably by at least 30° C., more preferably by 30° C. to 110° C. The melting point of the thermoplastic resin is preferably 70° C. to 200° C.

Specific examples of the thermoplastic resin include (1) polyolefins (e.g., polyethylene); (2) copolymers (e.g., ethylene/vinyl acetate copolymer) constituted by at least one kind of olefin (e.g., ethylene or propylene) and a repeating unit based on an olefinically unsaturated monomer having at least one kind of polar group; (3) polymers of vinyl and vinylidene halides (e.g., polyvinyl chloride, polyvinyl fluoride, and polyvinylidene fluoride); (4) polyamides (e.g., 12-nylon); (5) polystyrene; (6) polyacrylonitrile; (7) thermoplastic elastomers; (8) polyethylene oxide and polyacetal; (9) thermoplastic modified cellulose; (10) polysulfones; and (11) polymethyl(meth)acrylate.

More specific examples include (1) high-density polyethylene [e.g., product name: HI-ZEX 2100JP (manufactured by Mitsui Chemicals Inc.) and Marlex 6003 (manufactured by Phillips)]; (2) low-density polyethylene [e.g., product name: LC500 (manufactured by Japan Polychem Corp.) and DYMH-1 (manufactured by Union Carbide)]; (3) medium-density polyethylene [e.g., product name: 2604M (manufactured by Gulf)]; (4) ethylene/ethyl acrylate copolymer [e.g., product name: DPD6169 (manufactured by Union Carbide]; (5) ethylene/acrylic acid copolymer [e.g., product name: EAA455 (manufactured by Dow Chemical]; (6) hexafluoroethylene/tetrafluoroethylene copolymer [e.g., product name: FEP100 (manufactured by DuPont]; and (7) polyvinylidene fluoride [e.g., product name: Kynar 461 (manufactured by Penvalt)].

Preferably, such a thermoplastic resin has a weight-average molecular weight Mw of 10,000 to 5,000,000. These thermoplastic resins may be used one by one or in combination of two or more. Those having a structure in which different kinds of thermoplastic resins are crosslinked may be used as well.

From the viewpoint of attaining the effects of the present invention more securely, the PTC thermistor body 1 preferably includes a low molecular weight organic compound. In this case, from a viewpoint similar to that mentioned above, the low molecular weight organic compound included in the PTC thermistor body 1 is preferably a crystalline polymer. Preferably, the low molecular weight organic compound has a weight-average molecular weight of 100 to 2,000. Preferably, the low molecular weight organic compound is in a solid state at a temperature of 20° C. to 30° C.

A specific example of the low molecular weight organic compound is selected from waxes, oils and fats, fatty acids, higher alcohols, and the like. These low molecular weight organic compounds are commercially available, and commercially available products can be used as they are. These low molecular weight organic compounds may be used one by one or in combination of two or more.

Examples of ingredients of waxes and oils and fats include hydrocarbons (e.g., alkane type linear hydrocarbons with a carbon number of 22 or more), fatty acids (e.g., fatty acids of alkane type linear hydrocarbons with a carbon number of 22 or more), fatty acid esters (e.g., methyl esters of saturated fatty acids obtained from a saturated fatty acid having a carbon number of 20 or more and a lower alcohol such as methyl alcohol), fatty acid amides (e.g., primary amides of a saturated fatty acid having a carbon number of 10 or less and unsaturated fatty acid amides such as oleic acid amide and erucic acid amide), fatty acid amines (e.g., aliphatic primary amines having a carbon number of 16 or more), and higher alcohols (e.g., n-alkyl alcohols with a carbon number of 16 or more).

Specific examples of the low molecular weight organic compound include paraffin wax [e.g., tetracosane $C_{12}H_{50}$ having a melting point (mp) of 49° C. to 52° C., hexatriacontane $C_{36}H_{74}$ having with mp of 73° C., and product names HNP-10 (manufactured by Nippon Seiro Co., Ltd.) with mp of 75° C. and HNP-3 (manufactured by Nippon Seiro Co., Ltd.) with mp of 66° C.]; microcrystalline wax [e.g., product names Hi-Mic-1080 (manufactured by Nippon Seiro Co., Ltd.) with mp of 83° C.; Hi-Mic-1045 (manufactured by Nippon Seiro Co., Ltd.) with mp of 70° C., Hi-Mic-2045 (manufactured by Nippon Seiro Co., Ltd.) with mp of 64° C., Hi-Mic-3090 (manufactured by Nippon Seiro Co., Ltd.) with mp of 89° C., Seratta 104 (manufactured by Nippon Petroleum Refining Co., Ltd.) with mp of 96° C., and 155 Microwax (manufactured by Nippon Petroleum Refining Co., Ltd.) with mp of 70° C.]; fatty acids [e.g., behenic acid (manufactured by Nippon Fine Chemical Co., Ltd.) with mp of 81° C., stearic acid (manufactured by Nippon Fine Chemical Co. , Ltd. ) with mp of 72° C., and palmitic acid (manufactured by Nippon Fine Chemical Co., Ltd.) with mp of 64° C.]; fatty acid esters [e.g., arachic methyl ester (manufactured by Tokyo Kasei Kogyo Co., Ltd.) with mp of 48° C.]; and fatty acid amides [e.g., oleic acid amide (manufactured by Nippon Fine Chemical Co., Ltd.) with mp of 76° C.]. Depending on operating temperatures and the like, one or at least two kinds of the low molecular weight organic compound may be used selectively.

Preferably, the metal powder used in the PTC thermistor body 1 is mainly composed of nickel, specifically a filamentary particle made of nickel. Preferably, the metal powder includes a primary particle, and has a filamentary structure in which about 10 to 1,000 primary particles made of nickel are connected together like a chain. In the specification, "filamentary particle made of nickel" refers to a particle having a form in which about 10 to 1,000 primary particles (having an average particle size of 100 to 2,000 nm) made of nickel are connected together like a chain. In the specification, "specific surface area" of the filamentary particle made of nickel refers to the specific surface area determined by a nitrogen gas absorption technique based on the single-point BET method.

As with the particle exemplified by FIG. 2, the metal powder used in the PTC thermistor body preferably has a specific surface area of 0.8 to 2.5 $m^2 \cdot g^{-1}$ obtained by the BET single-point method and a bulk density of 0.25 to 0.40 $g \cdot cm^{-3}$ measured by a bulk density measurement test in compliance with JIS K5105.

Such a metal powder (electrically conductive particle) is preferably a particle obtained by a decomposition reaction of a compound expressed by the following formula (I):

$$M(CO)_4 \quad (I)$$

where M is at least one element selected from the group consisting of Ni, Fe, and Cu. Among them, Ni is the most preferable.

Namely, the particle is one generated as the reaction of $M(CO)_4 \rightarrow M+4CO$ progresses. The metal powder generated by the decomposition reaction of $M(CO)_4$ can control the particle size and particle form within the above-mentioned preferable range depending on the reaction condition.

Specific examples of the metal powder used in the PTC thermistor body are those commercially available under the product names of INCO Type 210, 255, and 270 nickel powder (manufactured by Inco Ltd.).

The primary particles preferably have an average particle size of at least 0.1 μm, more preferably about 0.5 to 4.0 μm. Most preferably, the primary particles have an average particle size of 1.0to 4.0 μm. The average particle size is measured by the Fischer subsieve method.

When the mass of the metal powder contained in the PTC thermistor body 1 is 4 to 7 times the total mass of the thermoplastic resin and low molecular weight organic compound, a sufficiently low resistance value at room temperature in the unoperated state, a large resistance change ratio, and reduced fluctuations in device resistance can be obtained.

If the amount of metal powder is too small, the resistance value at room temperature in the unoperated state cannot be made sufficiently low. If the amount of metal powder is too large, by contrast, a large resistance change ratio is hard to attain, thus yielding a nonuniform mixture, whereby fluctuations occur in the device resistance of the PTC thermistor 10.

A preferred embodiment of the method of making a PTC thermistor body and PTC thermistor will now be explained.

Initially, in a kneaded product preparing step, a kneaded product including at least a thermoplastic resin and an electrically conductive particle made of a metal powder is prepared. A case where the kneaded product further contains a low molecular weight organic compound will now be explained.

First, the thermoplastic resin and the low molecular weight organic compound are dissolved in a solvent capable of dissolving them. To the resulting solution, the metal powder dried beforehand is added. The mixture is heat-treated while being stirred with stirring means such as a mill, for example. This heat treatment is known as kneading. The heat treatment temperature is preferably at the melting point of the thermoplastic resin or higher, more preferably higher than the melting point of the thermoplastic resin by 5° C. to 40° C.

Known kneading techniques may be used for the kneading operation. It will be sufficient if the operation is carried out for about 10 to 120 minutes by using stirring means such as kneader, extruder, and mill, for example. Specifically, for example, Labo Plastomill (manufactured by Toyo Seiki Seisaku-sho, Ltd.) may be used.

When necessary, the kneaded product may further be pulverized, and thus pulverized product may be kneaded again. During kneading, an antioxidant may be mixed into the product in order to prevent the thermoplastic resin from thermally deteriorating. Phenols, organosulfurs, phosphites, and the like may be used as the antioxidant, for example.

The melting/kneading temperature and kneading time, or melting/kneading conditions for melting/kneading the same sample a plurality of times may be studied in the kneaded product preparing step, whereby the degree of dispersion (state of dispersion) of the metal powder in the PTC thermistor body 1 can be adjusted.

Subsequently, in a shaping step, the kneaded product is shaped into a plurality of sheet-like shaped articles (PTC thermistor bodies) More specifically, the kneaded product is rolled into a sheet having a predetermined thickness, which is then subjected to forming such as pressing, whereby sheet-like shaped articles (PTC thermistor bodies) can be obtained. Also, the sheet-like shaped article (PTC thermistor body) may be sheared into a size of about 1 mm×1 mm, for example.

Then, in a magnetization measuring step, the magnetization of the resulting shaped articles (PTC thermistor bodies) is measured while applying a magnetic field of $3.98 \times 10^5$ $A \cdot m^{-1}$ thereto. Here, all the shaped articles obtained may be subjected to magnetization measurement one by one. When all the shaped articles obtained can be considered to have the same dispersion state of constituent materials such as the metal powder (electrically conductive particle) contained therein, at least one shaped article may be chosen to measure the magnetization thereof, and the magnetization of all the shaped articles may be evaluated according to thus measured magnetization.

Here, the value of magnetization at the time when a magnetic field of $3.98 \times 10^5$ $A \cdot m^{-1}$ is applied to the thermistor body is the arithmetic mean value of data (magnetization values) obtained by at least five different measurement samples prepared under the same manufacturing condition.

From the viewpoint of attaining the effects of the present invention more securely, the minimum value of data (magnetization values) obtained by at least five different measurement samples is preferably $3.8 \times 10^{-5}$ to $4.0 \times 10^{-5}$ $Wb \cdot m \cdot kg^{-1}$. Further, from the viewpoint of attaining the effects of the present invention more securely, the maximum value of data (magnetization values) obtained by at least five different measurement samples is preferably $6.0 \times 10^{-5}$ to $6.1 \times 10^{-5}$ $Wb \cdot m \cdot kg^{-1}$. Also, from the viewpoint of attaining the effects of the present invention more securely, the difference between the maximum and minimum values (maximum value−minimum value) of data (magnetization values) obtained by at least five different measurement samples is preferably not greater than $0.8 \times 10^{-5}$ $Wb \cdot m \cdot kg^{-1}$. It will be more favorable if the difference between the maximum and minimum values (maximum value−minimum value) is smaller.

Next, in a selecting step, those satisfying a condition to yield a magnetization of $4.0 \times 10^{-5}$ to $6.0 \times 10^{-5}$ $Wb \cdot m \cdot kg^{-1}$ are chosen from the plurality of shaped articles, and those not satisfying the condition are excluded. Those satisfying the condition to yield a magnetization of $4.0 \times 10^{-5}$ to $6.0 \times 10^{-5}$ $Wb \cdot m \cdot kg^{-1}$ among the plurality of shaped articles are used as the PTC thermistor body 1 of the present invention.

Thereafter, using thus obtained PTC thermistor body 1, a thermistor 10 is completed by a known thermistor making technique. Namely, electrodes 2, 3 are prepared, and the PTC thermistor body 1 is disposed between the electrodes 2, 3. Then, leads 4, 5 are electrically connected to the electrodes 2, 3, thereby completing the thermistor 10.

The following grouping and pulverizing steps may be provided between the above-mentioned shaping and magnetization measuring steps. Namely, from the plurality of shaped articles obtained after the shaping step, those formed under the same shaping condition from the same kneaded product are grouped as those belonging to the same group, so as to form at least one group from the plurality of shaped articles. In this grouping step, the shaped articles of the kneaded product belonging to a single group formed under the same shaping condition from the same kneaded product are considered to have the same magnetization characteristic, and at least one of the shaped articles belonging to this group is selected as a magnetization characteristic evaluation sample representing the group.

Subsequently, in the pulverizing step, at least one of the shaped articles belonging to the same group in the above-mentioned at least one group is arbitrarily selected, and then thus selected at least one shaped article is pulverized, so as to obtain a pulverized product of shaped article for each group. Thus, only the shaped article acting as the magnetization characteristic evaluation sample is pulverized, and its magnetization is measured, so as to evaluate the magnetization characteristic of the whole group.

In this case, in the subsequent magnetization measuring step, the magnetization of the pulverized product (particle) obtained by pulverizing the PTC thermistor body is measured while applying a magnetic field of $3.98\times10^5$ $A\cdot m^{-1}$ thereto.

In the subsequent selecting step, the shaped articles of the group including the pulverized products satisfying the condition to yield a magnetization of $4.0\times10^{-5}$ to $6.0\times10^{-5}$ $Wb\cdot m\cdot kg^{-1}$ are chosen as the PTC thermistor body 1 of the present invention, and the shaped articles belonging to groups failing to satisfy the above-mentioned condition are excluded.

If the kneading condition in the kneading product preparing step and the shaping condition in the shaping step can be set beforehand by an experiment or the like such that the shaped articles obtained after the shaping step satisfy the condition to yield a magnetization of $4.0\times10^{-5}$ to $6.0\times10^{-5}$ $Wb\cdot m\cdot kg^{-1}$ when a magnetic field of $3.98\times10^5$ $A\cdot m^{-1}$ is applied thereto, the shaped articles obtained after the shaping step may be used as the PTC thermistor body 1 of the present invention without providing the magnetization measuring step and selecting step after the shaping step.

For example, the melting/kneading temperature and kneading time, or melting/kneading conditions for melting/kneading the same sample a plurality of times are studied in the kneaded product preparing step, whereby a condition optimizing the degree of dispersion (state of dispersion) of the metal powder in the PTC thermistor body 1 can be set.

EXAMPLES

The present invention will now be explained in further detail with reference to Examples and Comparative Examples, though the present invention is not limited by these Examples at all.

Table 1 shows constituent materials and their contents in each of thermistor bodies in accordance with Examples 1 to 5 and Comparative Examples 1 to 3. Table 2 shows results of measurement of magnetization in Examples 1 to 5and Comparative Examples 1 to 3. Table 3 shows results of evaluation of the individual thermistor bodies based on the results of measurement shown in Table 2. The "average value" of "magnetization" of each thermistor body shown in Table 3 is the arithmetic mean value of magnetization data (shown in Table 2) of 20 measurement samples prepared for each thermistor body.

Example 1

Low-density polyethylene [manufactured by Nippon Seiro Co., Ltd. under the product name of LC500 with a melting point (mp) of 108° C.], oleic acid amide (manufactured by Nippon Fine Chemical Co., Ltd. with a melting point of 76° C.), and a filamentary nickel powder (manufactured by Inco Ltd. under the product name of Type 210 nickel powder) were used as a thermoplastic resin, a low molecular weight organic compound, and a metal powder, respectively. The metal powder had a bulk density (BD) of 0.25 $g\cdot cm^{-3}$ and a specific surface area (SSA) of 2.42 $m^2\cdot g^{-1}$. The mixing ratio (mass ratio) of thermoplastic resin to low molecular weight organic compound to metal powder=14:3:83. In the following, "thermoplastic resin to low molecular weight organic compound to metal powder" will be referred to as "A:B:C".

First, the thermoplastic resin, low molecular weight organic compound, and metal powder were put into a mill, and were kneaded for 60minutes at 140° C. Thereafter, the resulting kneaded product was pulverized, and the pulverized product was put into the mill again and was kneaded again for 20 minutes at 140° C.

Subsequently, from the resulting kneaded product, 20 sheet-like shaped articles were formed. Specifically, this kneaded product was formed into a planar mass, which was then held by hot-press plates from both sides and shaped at 150° C., whereby 20 shaped articles each having a size of 50 mm×50 mm with a thickness of 5 mm were obtained. Then, all the 20 shaped articles were sheared, whereby 20 thermistor bodies (samples) were obtained. Thereafter, all the 20 thermistor bodies (samples) were pulverized into particles having a particle size of about 1 mm.

Next, the magnetization of each sample was measured while a magnetic field of $3.98\times10^5$ $A\cdot m^{-1}$ was applied thereto. For the measurement of magnetization, a vibrating sample magnetometer (manufactured by Toei Industry Co., Ltd.) was used.

Example 2

Low-density polyethylene (manufactured by Mitsui Chemicals Inc. under the product name of HI-ZEX 2100JP with a melting point of 127° C.), paraffin wax (manufactured by Nippon Seiro Co., Ltd. under the product name of HNP-10 with a melting point of 75° C.), and a filamentary nickel powder (manufactured by Inco Ltd. under the product name of Type 210 nickel powder) were used as a thermoplastic resin, a low molecular weight organic compound, and a metal powder, respectively. The metal powder had a bulk density (BD) of 0.37 g $cm^{-3}$ and a specific surface area (SSA) of 1.97 $m^2\cdot g^{-1}$. The mixing ratio (mass ratio) was A:B:C=14:3:83.

First, the thermoplastic resin, low molecular weight organic compound, and metal powder were put into a mill, and were kneaded for 30 minutes at 155° C. Then, the resulting kneaded product was pulverized, and the pulverized product was put into the mill again and was kneaded again for 30 minutes at 150° C. Thereafter, using the same procedure and condition as with Example 1, 20 sheet-like shaped articles were formed from the resulting kneaded product. Further, using the same procedure and condition as with Example 1, all the 20 thermistor bodies (samples) were pulverized into particles having a particle size of about 1 mm. Subsequently, using the same procedure and condition as with Example 1, the magnetization of each sample was measured while a magnetic field of $3.98\times10^5$ $A\cdot m^{-1}$ was applied thereto.

Example 3

Low-density polyethylene (manufactured by Mitsui Chemicals Inc. under the product name of SP2510 with a melting point of 121° C.), paraffin wax (manufactured by Nippon Seiro Co., Ltd. under the product name of HNP-10 with a melting point of 75° C.), and a filamentary nickel powder (manufactured by Inco Ltd. under the product name of Type 210 nickel powder) were used as a thermoplastic resin, a low molecular weight organic compound, and a metal powder, respectively. The metal powder had a bulk density (BD) of 0.32 $g\cdot cm^{-3}$ and a specific surface area (SSA) of 1.73 $m^2\cdot g^{-1}$. The mixing ratio (mass ratio) was A:B:C=14:3:83.

First, the thermoplastic resin, low molecular weight organic compound, and metal powder were put into a mill, and were kneaded for 60 minutes at 160° C. Then, using the same procedure and condition as with Example 1, 20 sheet-like shaped articles were formed from the resulting kneaded product. Thereafter, using the same procedure and condition as with Example 1, all the 20 thermistor bodies (samples) were pulverized into particles having a particle size of about 1 mm. Subsequently, using the same procedure and condition as with Example 1, the magnetization of each sample was measured while a magnetic field of $3.98\times10^5$ $A\cdot m^{-1}$ was applied thereto.

Example 4

Low-density polyethylene (manufactured by Nippon Seiro Co., Ltd. under the product name of LC500 with a melting point of 108° C.), oleic acid amide (manufactured by Nippon Fine Chemical Co., Ltd. with a melting point of 76° C.), and a filamentary nickel powder (manufactured by Inco Ltd. under the product name of Type 210 nickel powder) were used as a thermoplastic resin, a low molecular weight organic compound, and a metal powder, respectively. The metal powder had a bulk density (BD) of 0.39 $g\cdot cm^{-3}$ and a specific surface area (SSA) of 1.51 $m^2\cdot g^{-1}$. The mixing ratio (mass ratio) was A:B:C=12:3:85.

Example 5

PVDF (manufactured by Mitsubishi Chemical Corp. under the product name of Kynar 7200 with a melting point of 122° C.), paraffin wax (manufactured by Nippon Seiro Co., Ltd. under the product name of HNP-10 with a melting point of 75° C.), and a filamentary nickel powder (manufactured by Inco Ltd. under the product name of Type 210 nickel powder) were used as a thermoplastic resin, a low molecular weight organic compound, and a metal powder, respectively. The metal powder had a bulk density (BD) of 0.33 $g\cdot cm^{-3}$ and a specific surface area (SSA) of 1.88 $m^2\cdot g^{-1}$. The mixing ratio (mass ratio) was A:B:C=16:3:81.

Comparative Example 1

Low-density polyethylene (manufactured by Mitsui Chemicals Inc. under the product name of SP2510 with a melting point of 121° C.), paraffin wax (manufactured by Nippon Seiro Co., Ltd. under the product name of HNP-10 with a melting point of 75° C.), and a filamentary nickel powder (manufactured by Inco Ltd. under the product name of Type 255 nickel powder) were used as a thermoplastic resin, a low molecular weight organic compound, and a metal powder, respectively. The metal powder had a bulk density (BD) of 0.65 $g\cdot cm^{-3}$ and a specific surface area (SSA) of 0.53 $m^2\cdot g^{-1}$. This metal powder had a small specific surface area and a large bulk density, while in a chain-like structure such as the one shown in FIG. 2. The mixing ratio (mass ratio) was A:B:C=14:3:83.

For yielding the PTC thermistor body of Comparative Example 1, the metal powder was not dried. The thermoplastic resin, low molecular weight organic compound, and metal powder were put into a mill, and were kneaded for 60 minutes at 150° C. Then, the resulting kneaded product was pulverized, and the pulverized product was put into the mill again and was kneaded again for 30 minutes at 150° C. Thereafter, using the same procedure and condition as with Example 1, 20 sheet-like shaped articles were formed from the resulting kneaded product. Further, using the same procedure and condition as with Example 1, all the 20 thermistor bodies (samples) were pulverized into particles having a particle size of about 1 mm. Subsequently, using the same procedure and condition as with Example 1, the magnetization of each sample was measured while a magnetic field of $3.98\times10^5$ $A\cdot m^{-1}$ was applied thereto.

Comparative Example 2

Low-density polyethylene (manufactured by Nippon Seiro Co., Ltd. under the product name of LC500 with a melting point of 108° C.), paraffin wax (manufactured by Nippon Seiro Co., Ltd. under the product name of HNP-10 with a melting point of 75° C.), and a carbon black powder (manufactured by Tokai Carbon Co., Ltd. under the product name of TOKABLACK #4500 carbon black powder) were used as a thermoplastic resin, a low molecular weight organic compound, and an electrically conductive fine particle, respectively. The electrically conductive fine particle had a bulk density (BD) of 0.22 $g\cdot cm^{-3}$ and a specific surface area (SSA) of 61.2 $m^2\cdot g^{-1}$. The mixing ratio (mass ratio) was A:B:C=57:3:40.

For yielding the PTC thermistor body of Comparative Example 2, the electrically conductive fine particle was not dried. The thermoplastic resin, low molecular weight organic compound, and electrically conductive fine particle were put into a mill, and were kneaded for 40 minutes at 150° C. Thereafter, using the same procedure and condition as with Example 1, 20 sheet-like shaped articles were formed from the resulting kneaded product. Further, using the same procedure and condition as with Example 1, all the 20 thermistor bodies (samples) were pulverized into particles having a particle size of about 1 mm. Subsequently, using the same procedure and condition as with Example 1, the magnetization of each sample was measured while a magnetic field of $3.98\times10^5$ $A\cdot m^{-1}$ was applied thereto.

Comparative Example 3

Low-density polyethylene (manufactured by Mitsui Chemicals Inc. under the product name of SP2510 with a melting point of 121° C.), paraffin wax (manufactured by Nippon Seiro Co., Ltd. under the product name of HNP-10 with a melting point of 75° C.), and a commercially available pulverized product of nickel powder (manufactured by Shimura Kako Co., Ltd.) were used as a thermoplastic resin, a low molecular weight organic compound, and a metal powder, respectively. The starting material of this pulverized product was different from $M(CO)_4$. This pulverized product had a structure such as the one shown in FIG. 3, which was different from a chain-like (filamentary) structure. The metal powder had a bulk density (BD) of 2.45 $g \cdot cm^{-3}$ and a specific surface area (SSA) of 1.20 $m^2 \cdot g^{-1}$. The mixing ratio (mass ratio) was A:B:C=14:3:83.

For yielding the PTC thermistor body of Comparative Example 3, the metal powder was not dried. The thermoplastic resin, low molecular weight organic compound, and metal powder were put into a mill, and were kneaded for 60 minutes at 150° C. Thereafter, using the same procedure and condition as with Example 1, 20 sheet-like shaped articles were formed from the resulting kneaded product. Further, using the same procedure and condition as with Example 1, all the 20 thermistor bodies (samples) were pulverized into particles having a particle size of about 1 mm. Subsequently, using the same procedure and condition as with Example 1, the magnetization of each sample was measured while a magnetic field of $3.98 \times 10^5$ $A \cdot m^{-1}$ was applied thereto.

TABLE 2-continued

| | MAGNETIZATION × $10^{-5}$ (wb · m/kg) | | | | | | | |
|---|---|---|---|---|---|---|---|---|
| n | EX. 1 | EX. 2 | EX. 3 | EX. 4 | EX. 5 | COMP. EX. 1 | COMP. EX. 2 | COMP. EX. 3 |
| 16 | 5.1 | 5.0 | 5.3 | 5.5 | 4.2 | 4.6 | 0.0 | 6.3 |
| 17 | 4.9 | 5.0 | 5.4 | 5.3 | 4.4 | 3.9 | 0.0 | 6.5 |
| 18 | 5.1 | 4.9 | 5.3 | 5.5 | 4.1 | 3.0 | 0.0 | 6.4 |
| 19 | 5.0 | 4.9 | 5.7 | 5.3 | 4.3 | 4.5 | 0.0 | 5.9 |
| 20 | 5.1 | 4.9 | 5.4 | 5.6 | 4.5 | 3.8 | 0.0 | 6.1 |

TABLE 1

| | A: THERMOPLASTIC RESIN | B: LOW MOLECULAR WEIGHT ORGANIC COMPOUND | C: METAL POWDER OR ELECTRICALLY CONDUCTIVE FINE PARTICLE | A + B + C = 100 (wt %) |
|---|---|---|---|---|
| EX.1 | PE | | Ni POWDER Type255 | A:14 |
| | LC500 | OLEIC ACID AMIDE | BD:0.65 ($g/cm^3$) | B:3 |
| | mp:108° C. | mp: 76° C. | SSA:0.53 ($m^2/g$) | C:83 |
| EX.2 | PE | PARAFFIN WAX | Ni POWDER Type210 | A:14 |
| | HI-ZEX 2100JP | HNP-10 | BD:0.37 ($g/cm^3$) | B:3 |
| | mp:127° C. | mp: 75° C. | SSA:1.97 ($m^2/g$) | C:83 |
| EX.3 | PE | PARAFFIN WAX | Ni POWDER Type210 | A:14 |
| | SP2510 | HNP-10 | BD:0.32 ($g/cm^3$) | B:3 |
| | mp:121° C. | mp: 75° C. | SSA:1.73 ($m^2/g$) | C:83 |
| EX.4 | PE | | Ni POWDER Type210 | A:12 |
| | LC500 | OLEIC ACID AMIDE | BD:0.39 ($g/cm^3$) | B:3 |
| | mp:108° C. | mp: 76° C. | SSA:1.51($m^2/g$) | C:85 |
| EX.5 | PVDF | PARAFFIN WAX | Ni POWDER Type210 | A:16 |
| | kynar7200 | HNP-10 | BD:0.33 ($g/cm^3$) | B:3 |
| | mp:122° C. | mp: 75° C. | SSA:1.88 ($m^2/g$) | C:81 |
| COMP. EX. 1 | PE | PARAFFIN WAX | Ni POWDER Type210 | A:14 |
| | SP2510 | HNP-10 | BD:0.38 ($g/cm^3$) | B:3 |
| | mp:121° C. | mp: 75° C. | SSA:1.53 ($m^2/g$) | C:83 |
| COMP. EX. 2 | PE | PARAFFIN WAX | CARBON BLACK #4500 | A:57 |
| | LC500 | HNP-10 | BD:0.22 ($g/cm^3$) | B:3 |
| | mp:108° C. | mp: 75° C. | SSA:61.2 ($m^2/g$) | C:40 |
| COMP. EX. 3 | PE | PARAFFIN WAX | PULVERIZED PRODUCT OF | A:14 |
| | SP2510 | HNP-10 | Ni POWDER | B:3 |
| | mp:121° C. | mp: 75° C. | BD:2.45 ($g/cm^3$) | C:83 |
| | | | SSA:1.20 ($m^2/g$) | |

TABLE 2

| | MAGNETIZATION × $10^{-5}$ (wb · m/kg) | | | | | | | |
|---|---|---|---|---|---|---|---|---|
| n | EX. 1 | EX. 2 | EX. 3 | EX. 4 | EX. 5 | COMP. EX. 1 | COMP. EX. 2 | COMP. EX. 3 |
| 1 | 5.2 | 5.0 | 5.1 | 5.6 | 4.2 | 3.7 | 0.0 | 6.4 |
| 2 | 5.0 | 4.8 | 5.4 | 5.6 | 4.0 | 3.4 | 0.0 | 5.6 |
| 3 | 5.0 | 5.1 | 5.4 | 5.3 | 4.1 | 3.9 | 0.0 | 6.0 |
| 4 | 5.1 | 5.1 | 5.1 | 5.7 | 4.1 | 4.5 | 0.0 | 6.1 |
| 5 | 5.1 | 5.0 | 5.3 | 5.7 | 4.6 | 3.5 | 0.0 | 6.0 |
| 6 | 5.0 | 5.0 | 5.1 | 5.9 | 4.3 | 3.8 | 0.0 | 5.9 |
| 7 | 5.1 | 5.0 | 5.0 | 5.9 | 4.5 | 4.3 | 0.0 | 6.4 |
| 8 | 5.0 | 4.8 | 5.3 | 6.0 | 4.4 | 4.2 | 0.0 | 5.8 |
| 9 | 4.9 | 4.8 | 5.2 | 5.2 | 4.4 | 3.9 | 0.0 | 6.2 |
| 10 | 5.1 | 4.8 | 5.1 | 5.5 | 4.5 | 3.8 | 0.0 | 6.8 |
| 11 | 5.2 | 4.9 | 5.3 | 5.4 | 4.8 | 4.5 | 0.0 | 5.8 |
| 12 | 4.9 | 4.9 | 5.3 | 5.6 | 4.0 | 3.9 | 0.0 | 6.2 |
| 13 | 5.1 | 5.0 | 5.3 | 5.7 | 4.7 | 4.1 | 0.0 | 6.3 |
| 14 | 5.1 | 5.0 | 5.2 | 5.2 | 4.2 | 3.9 | 0.0 | 5.1 |
| 15 | 5.0 | 4.6 | 5.1 | 5.3 | 4.2 | 4.0 | 0.0 | 6.5 |

TABLE 3

| | MAGNETIZATION × $10^{-5}$ (wb · m/kg) | | | | |
|---|---|---|---|---|---|
| | APPLIED MAGNETIC FIELD × $10^5$(A/m) | AVE | MIN | MAX | DIF |
| EX. 1 | 3.98 | 5.1 | 4.9 | 5.2 | 0.3 |
| EX. 2 | 3.98 | 4.9 | 4.6 | 5.1 | 0.5 |
| EX. 3 | 3.98 | 5.3 | 5.0 | 5.7 | 0.7 |
| EX. 4 | 3.98 | 5.6 | 5.2 | 6.0 | 0.8 |
| EX. 5 | 3.98 | 4.3 | 4.0 | 4.8 | 0.8 |
| COMP. EX. 1 | 3.98 | 3.9 | 3.0 | 4.6 | 1.6 |
| COMP. EX. 2 | 3.98 | 0.0 | 0.0 | 0.0 | 0.0 |
| COMP. EX. 3 | 3.98 | 6.1 | 5.1 | 6.8 | 1.7 |

As shown in Table 3, each of the PTC thermistor bodies in accordance with Examples 1 to 5has average, minimum, and maximum values of magnetization falling within the range of $4.0\times10^{-5}$ to $6.0\times10^{-5}$ Wb·m·kg$^{-1}$, and thus can be considered to be one in which the thermoplastic resin, low molecular weight organic compound, and metal powder are dispersed in a sufficiently uniform fashion.

By contrast, each of the PTC thermistor bodies in accordance with Comparative Examples 1 and 3 has an average value of magnetization outside the range of $4.0\times10^{-5}$ to $6.0\times10^{-5}$ Wb·m·kg$^{-1}$, and thus can be considered to be one in which the thermoplastic resin, low molecular weight organic compound, and metal powder are not dispersed in a sufficiently uniform fashion. The PTC thermistor body of Comparative Example 2 uses a carbon black powder instead of a metal powder as an electrically conductive fine particle, thereby yielding no magnetization.

Resistance vs. Temperature Characteristic Evaluating Test of PTC Thermistor

Figure 5:
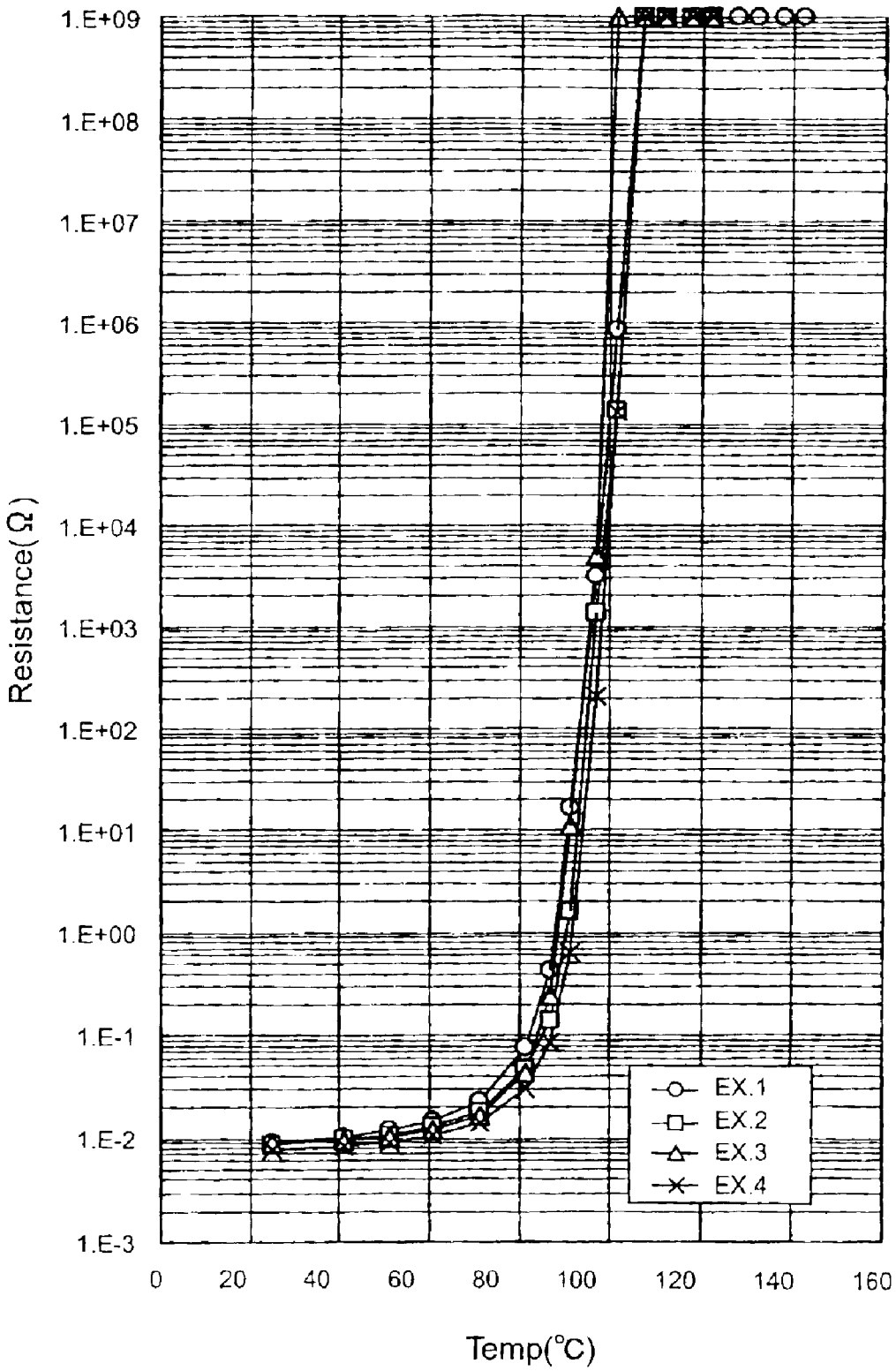
FIG. 5 is a graph showing respective resistance vs. temperature characteristics of PTC thermistors in accordance with Examples 1 to 4.
Figure 6:
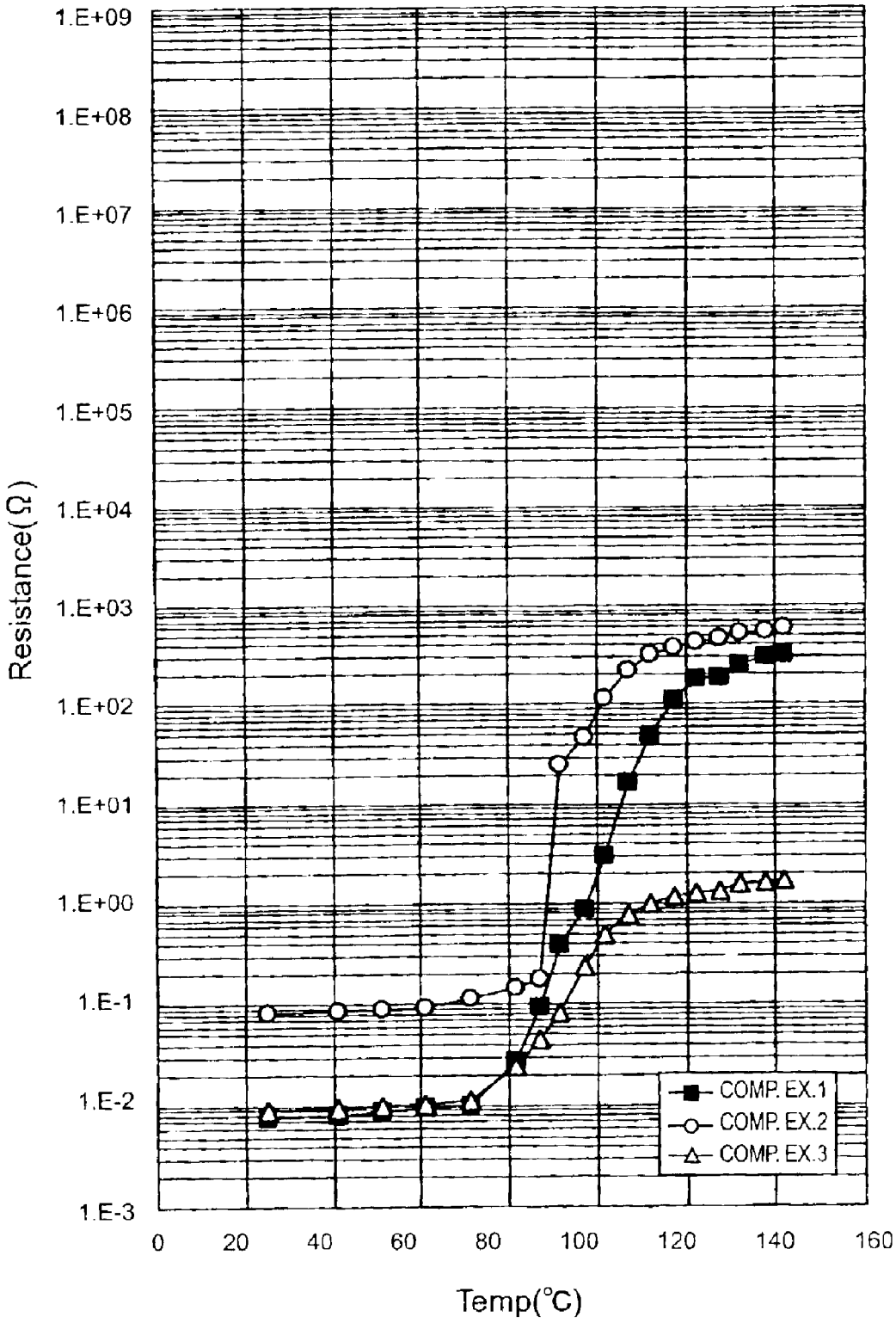
FIG. 6 is a graph showing respective resistance vs. temperature characteristics of PTC thermistors in accordance with Comparative Examples 1 to 3.

The PTC thermistor bodies of Examples 1 to 4 and Comparative Examples 1 to 3 were produced separately, and respective thermistors were constructed therefrom. Then, a resistance vs. temperature characteristic evaluating test was carried out for each PTC thermistor. FIG. 5 is a graph showing respective temperature vs. temperature characteristics of Examples 1 to 4. FIG. 6 is a graph showing respective temperature vs. temperature characteristics of Comparative Examples 1 to 3.

Each PTC thermistor was produced by the following procedure. First, the above-mentioned sheet-like PTC thermistor body was prepared. Ni foils (electrodes) each having a thickness of 15 μm were disposed on both sides of the sheet-like PTC thermistor body, respectively, and the PTC thermistor body and the Ni foils were hot-pressed at 150° C. by a heat press machine, so as to yield a shaped article having a thickness of 0.3 mm and a diameter of 100 mm as a whole. Then, this shaped article was sheared into 1 mm×1 mm, and was heat-treated, so as to advance the crosslinking reaction of polymer materials within the shaped article. After being stabilized thermally and mechanically, the shaped article was punched into a rectangular form of 9 mm×3 mm. This yielded the PTC thermistor having a structure in which a sheet-like thermistor body including a low molecular weight organic compound, a thermistor body, and an electrically conductive particle was disposed (held) closely in contact with two electrodes formed from Ni foils.

Though the crosslinking reaction of polymer materials within the shaped article was advanced by heat treatment here, it will be sufficient if a crosslinking method is carried out when necessary. Known methods such as radiation crosslinking, chemical crosslinking with organic peroxides, and aqueous crosslinking in which a silane coupling agent is grafted so as to condense silanol groups may be used.

The resistance vs. temperature characteristic of each PTC thermistor was obtained by heating the PTC thermistor within a high-temperature chamber, cooling it to a predetermined temperature, and then measuring the resistance value at this temperature by using the four-probe method.

As can be seen from there results shown in FIG. 5, each of the PTC thermistors of Examples 1 to 4 has a low resistance value at room temperature when not operating, i.e., 0.01 to 0.05 Ω. It is also seen that each of the PTC thermistors of Examples 1 to 4 exhibits a steep rising edge during operation, a high resistance change ratio from the unoperated state to the operated state, and a difference of 8 digits or more between the average resistance value within the temperature range of 20° C. to 40° C. and the average resistance value within the temperature range of 120° C. to 140° C.

As can be seen from the results shown in FIG. 6, each of the PTC thermistors of Comparative Examples 1 to 3 has a resistance value of 0.01 to 0.10 Ω when not operating, which is low to some extent. However, each of the PTC thermistors of Comparative Examples 1 to 3 exhibits no steep rising edge during operation, a low resistance change ratio from the unoperated state to the operated state, and a difference of about 2 to 3 digits between the average resistance value within the temperature range of 20° C. to 40° C. and the average resistance value within the temperature range of 120° C. to 140° C.

Figure 7:
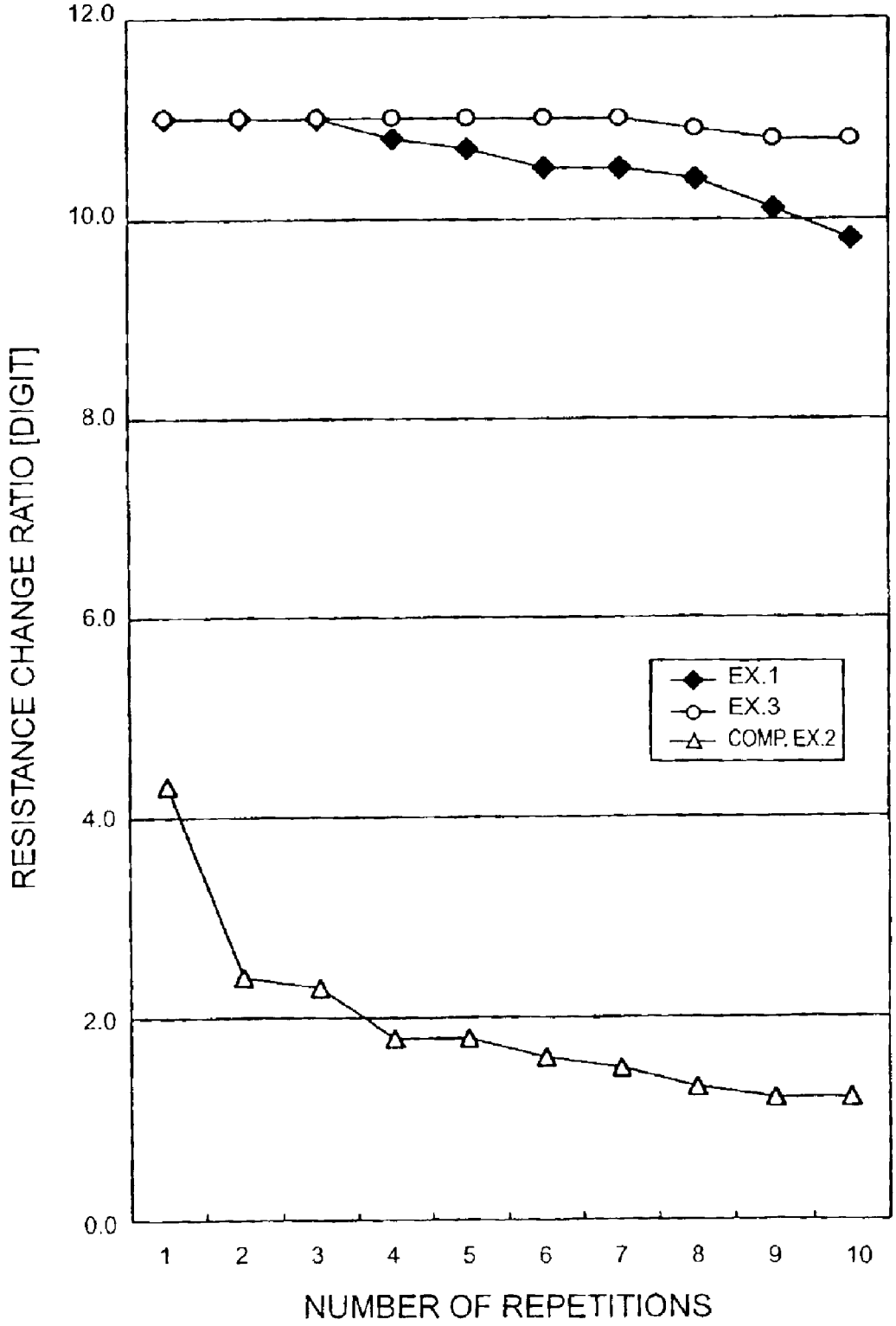
FIG. 7 is a graph for comparing respective changes in resistance value obtained when the PTC thermistors in accordance with Examples 1 and 3 and Comparative Example 2 are operated repeatedly (operated/unoperated).

FIG. 7 is a graph for comparing respective changes in resistance value obtained when the PTC thermistors in accordance with Examples 1 and 3 and Comparative Example 2 are operated repeatedly (operated/unoperated).

Here, an operation of heating each of the PTC thermistors of Examples 1 and 3 and Comparative Example 2 in a high-temperature chamber, cooling it to a predetermined temperature, and measuring its resistance value at this temperature by using the four-probe method so as to yield a resistance vs. temperature curve was repeated 10 times. For easily comparing transitions of resistance change ratio at that time, transitions of the difference between the digit number of average resistance value within the temperature range of 20° C. to 40° C. and the digit number of average resistance value within the temperature range of 120° C. to 140° C. were plotted in the graph.

As can be seen from FIG. 7, each of the PTC thermistors of Examples 1 and 3 in accordance with the present invention exhibits a very small difference of 1 digit or less between the digit number of average resistance value within the temperature range of 120° C. to 140° C. and the digit number of average resistance value within the temperature range of 120° C. to 140° C. when a cycle of unoperated and operated states is repeated 10 times. By contrast, the PTC thermistor of Comparative Example 2 is seen to exhibit a very large difference of about 3 digits between the digit number of average resistance value within the temperature range of 120° C. to 140° C. and the digit number of average resistance value within the temperature range of 120° C. to 140° C. when a cycle of unoperated and operated states is repeated 10 times.

As explained in the foregoing, the present invention can provide a PTC thermistor body capable of constructing a highly reliable PTC thermistor which can yield a sufficiently large change ratio between the resistance value at room temperature when not operating and that during operation, and sufficiently keep the resistance value obtained at an initial stage of use even after being operated repeatedly; and a PTC thermistor comprising the same. Also, the present invention can provide a method of making a PTC thermistor body which can construct the above-mentioned PTC thermistor body of the present invention easily and securely, and a method of making a PTC thermistor with a high product yield, which can construct the above-mentioned PTC thermistor of the present invention easily and securely.

What is claimed is:

1. At least twenty arbitrarily selected PTC thermistor bodies produced from a common body of thermistor body material, each of the at least twenty PTC thermistor bodies disposed between a pair of electrodes opposing each other in a PTC thermistor having a positive resistance vs. temperature characteristic;

said PTC thermistor bodies including, at least, a thermoplastic resin and an electrically conductive powder that includes an electrically conductive particle made of a metal;

said thermoplastic resin and electrically conductive powder having respective contents and a state of dispersion adjusted so as to yield an average magnetization value of $4.0\times10^{-5}$ to $6.0\times10^{-5}$ $Wb\cdot m\cdot kg^{-1}$ when a magnetic field of $3.98\times10^{5}$ $A\cdot m^{-1}$ is applied to each PTC thermistor body within the at least twenty PTC thermistor bodies, wherein the average magnetization value is an average value obtained from measurements of the at least twenty PTC thermistor bodies produced from said common body of thermistor body material;

said electrically conductive powder including a particle having a specific surface area of 0.8 to 2.5 $m^2\cdot g^{-1}$ and a bulk density of 0.25 to 0.40 $g\cdot cm^{-1}$.

2. The PTC thermistor bodies according to claim 1, wherein said electrically conductive particle is a particle obtained by a decomposition reaction of a compound expressed by the following formula (I):

$$M(CO)_4 \quad (I)$$

where M is at least one element selected from the group consisting of Ni, Fe, and Cu.

3. The PTC thermistor bodies according to claim 1, wherein said electrically conductive particle is a particle mainly composed of nickel.

4. The PTC thermistor bodies according to claim 1, wherein said electrically conductive particle is a filamentary particle.

5. The PTC thermistor bodies according to claim 1, wherein said thermoplastic resin is made of a crystalline polymer having a melting point of 70° C. to 200° C.

6. The PTC thermistor bodies according to claim 1, further including a low molecular weight organic compound;

wherein said low molecular weight organic compound has a weight-average molecular weight of 100 to 2,000; and wherein said thermoplastic resin has a melting point higher than that of said low molecular weight organic compound.

7. The PTC thermistor bodies according to claim 1, wherein said thermoplastic resin has a weight-average molecular weight of 10,000 to 5,000,000.

8. At least twenty arbitrarily selected PTC thermistor bodies produced from a common body of thermistor body material, each of the at least twenty PTC thermistor bodies disposed between a pair of electrodes opposing each other in a PTC thermistor having a positive resistance vs. temperature characteristic;

said PTC thermistor bodies including, at least, a thermoplastic resin and an electrically conductive powder that includes an electrically conductive particle made of a metal;

said thermoplastic resin and electrically conductive powder having respective contents and a state of dispersion adjusted so as to yield an average magnetization value of $4.0\times10^{-5}$ to $6.0\times10^{-5}$ $Wb\cdot m\cdot kg^{-1}$ when a magnetic field of $3.98\times10^{5}$ $A\cdot m^{-1}$ is applied to a pulverized product of each PTC thermistor within the at least twenty PTC thermistor bodies, wherein the average magnetization value is an average value obtained from measurements of the at least twenty PTC thermistor pulverized products produced from said common body of thermistor body material;

said electrically conductive powder including a particle having a specific surface area of 0.8 to 2.5 $m^2\cdot g^{-1}$ and a bulk density of 0.25 to 0.40 $g\cdot cm^{-3}$.

9. The PTC thermistor bodies according to claim 8, wherein said electrically conductive particle is a particle obtained by a decomposition reaction of a compound expressed by the following formula (I):

$$M(CO)_4 \quad (I)$$

where M is at least one element selected from the group consisting of Ni, Fe, and Cu.

10. The PTC thermistor bodies according to claim 8, wherein said electrically conductive particle is a particle mainly composed of nickel.

11. The PTC thermistor bodies according to claim 8, wherein said electrically conductive particle is a filamentary particle.

12. The PTC thermistor bodies according to claim 8, wherein said thermoplastic resin is made of a crystalline polymer having a melting point of 70° C. to 200° C.

13. The PTC thermistor bodies according to claim 8, further including a low molecular weight organic compound;

wherein said low molecular weight organic compound has a weight-average molecular weight of 100 to 2,000; and wherein said thermoplastic resin has a melting point higher than that of said low molecular weight organic compound.

14. The PTC thermistor bodies according to claim 8, wherein said thermoplastic resin has a weight-average molecular weight of 10,000 to 5,000,000.

15. A PTC thermistor comprising, at least, a pair of electrodes opposing each other and a thermistor body, disposed between said pair of electrodes, having a positive resistance vs. temperature characteristic;

wherein said PTC thermistor body is one of the at least twenty PTC thermistor bodies according to claim 1.

16. A PTC thermistor comprising, at least, a pair of electrodes opposing each other and a thermistor body, disposed between said pair of electrodes, having a positive resistance vs. temperature characteristic;

wherein said PTC thermistor body is one of the at least twenty PTC thermistor bodies according to claim 8.

17. A method of making at least twenty arbitrarily selected PTC thermistor bodies from a common body of thermistor body material, each of the at least twenty PTC thermistor bodies disposed between a pair of electrodes opposing each other in a PTC thermistor having a positive resistance vs. temperature characteristic;

said method comprising:

a kneaded product preparing step of preparing a kneaded product including, at least, a thermoplastic resin and an electrically conductive powder that includes an electrically conductive particle made of a metal; and a shaping step of shaping said kneaded product into at least twenty planar shaped articles;

wherein a kneading condition in said kneaded product preparing step and a shaping condition in said shaping step are adjusted such that said at least twenty shaped products satisfy a condition to yield an average magnetization value of $4.0\times10^{-5}$ to $6.0\times10^{-5}$ $Wb\cdot m\cdot kg^{-1}$ when a magnetic field of $3.98\times10^{5}$ $A\cdot m^{-1}$ is applied thereto, wherein the magnetization value is an average value obtained from measurements of at least twenty different shaped products produced from the kneaded product;

wherein said electrically conductive powder includes a particle having a specific surface area of 0.8 to 2.5 $m^2\cdot g^{-1}$ and a bulk density of 0.25 to 0.40 $g\cdot cm^{-3}$.

18. A method of making at least twenty PTC thermistor bodies according to claim 17, wherein said electrically conductive particle is a particle obtained by a decomposition reaction of a compound expressed by the following formula (I):

$$M(CO)_4 \quad (I)$$

where M is at least one element selected from the group consisting of Ni, Fe, and Cu.

19. A method of making at least twenty PTC thermistor bodies according to claim 17, wherein said electrically conductive particle is a particle mainly composed of nickel.

20. A method of making at least twenty PTC thermistor bodies according to claim 17, wherein said electrically conductive particle is a filamentary particle.

21. A method of making at least twenty PTC thermistor bodies according to claim 17, wherein said thermoplastic resin is made of a crystalline polymer having a melting point of 70° C. to 200° C.

22. A method of making at least twenty PTC thermistor bodies according to claim 17, wherein said at least twenty PTC thermistor bodies further include a low molecular weight organic compound;

wherein said low molecular weight organic compound has a weight-average molecular weight of 100 to 2,000; and wherein said thermoplastic resin has a melting point higher than that of said low molecular weight organic compound.

23. A method of making at least twenty PTC thermistor bodies according to claim 17, wherein said thermoplastic resin has a weight-average molecular weight of 10,000 to 5,000,000.

24. A method of making a PTC thermistor comprising, at least, a pair of electrodes opposing each other and a thermistor body, disposed between said pair of electrodes, having a positive resistance vs. temperature characteristic;

said method comprising:

a body forming step of forming a PTC thermistor body by the method according to claim 17; and a step of disposing said PTC thermistor body between said pair of electrodes and electrically connecting said pair of electrodes and said PTC thermistor body to each other.

* * * * *